US005372439A

United States Patent [19]

Poole et al.

[11] Patent Number: 5,372,439

[45] Date of Patent: Dec. 13, 1994

[54] THERMAL TRANSFER PRINTER WITH CONTROLLED RIBBON FEED

[75] Inventors: David L. Poole, Libertyville; Jeffrey R. Kaufman, Waukegan; Michael K. Platt, Mount Prospect, all of Ill.

[73] Assignee: Zebra Technologies Corporation, Vernon Hills, Ill.

[21] Appl. No.: 993,114

[22] Filed: Dec. 18, 1992

[51] Int. Cl.[5] ..... B41J 33/36

[52] U.S. Cl. ..... 400/232; 400/235

[58] Field of Search ..... 400/225, 232, 233, 235, 400/235.1

[56] References Cited

U.S. PATENT DOCUMENTS

| | | | |
|---|---|---|---|
| 2,734,614 | 2/1956 | Page | 400/232 |
| 3,984,809 | 10/1976 | Dertouzos et al. | 400/120 |
| 4,406,553 | 9/1983 | Nally et al. | 400/234 |
| 4,440,514 | 4/1984 | Keiter et al. | 400/232 |
| 4,456,392 | 6/1984 | Nozaki et al. | 400/229 |
| 4,475,829 | 10/1984 | Goff, Jr. et al. | 400/208 |
| 4,490,059 | 12/1984 | Daughters | 400/235.1 |
| 4,558,963 | 12/1985 | Applegate et al. | 400/232 |
| 4,619,537 | 10/1986 | Do et al. | 400/232 |
| 4,709,242 | 11/1987 | Uchikata et al. | 400/231 |
| 4,772,144 | 9/1988 | Weed | 400/235.1 |
| 4,790,675 | 12/1988 | Surti | 400/208 |
| 4,838,718 | 6/1989 | Okumura et al. | 400/248 |
| 5,122,882 | 6/1992 | Ishida et al. | 400/232 |
| 5,137,378 | 8/1992 | Satoh | 400/231 |

FOREIGN PATENT DOCUMENTS

| | | | |
|---|---|---|---|
| 62184 | 5/1981 | Japan | 400/231 |
| 155984 | 3/1982 | Japan | 400/120 |
| 74181 | 5/1982 | Japan | 400/232 |
| 84865 | 5/1982 | Japan | 400/303 |
| 201686 | 11/1983 | Japan . | |
| 184687 | 10/1984 | Japan | 400/231 |
| 38191 | 2/1985 | Japan | 400/120 MP |
| 42087 | 3/1985 | Japan | 400/232 |
| 161161 | 8/1985 | Japan | 400/120 |
| 232988 | 11/1985 | Japan | 400/232 |
| 62-218165 | of 1986 | Japan | 400/120 |
| 222786 | of 1986 | Japan | 400/120 |
| 41578 | 2/1986 | Japan | 400/232 |
| 199972 | 9/1986 | Japan | 400/225 |
| 228979 | 10/1986 | Japan | 400/232 |
| 50182 | 3/1987 | Japan | 400/232 |
| 15779 | 1/1988 | Japan | 400/231 |
| 54275 | 3/1988 | Japan | 400/232 |
| 62769 | 3/1988 | Japan | 400/231 |
| 107569 | 5/1988 | Japan | 400/232 |
| 114453 | 5/1989 | Japan | 400/232 |
| 286884 | 11/1989 | Japan | 400/232 |
| 22082 | 1/1990 | Japan | 400/120 |
| 500008 | 8/1992 | Japan | 400/232 |

OTHER PUBLICATIONS

"Reduced Consumption of Ribbon on Impact Printer", Sweet et al; *IBM Tech Disc Bull;* vol. 23, No. 8, p. 3506; Jan. 1981.

"Regulated Speed Ribbon Drive"; Davis et al; *IBM Tech Disc Bull;* vol. 23, No. 11, pp. 4891–4895; Apr. 1981.

*Primary Examiner*—David A. Wiecking

*Attorney, Agent, or Firm*—Emrich & Dithmar

[57] ABSTRACT

A thermal transfer printer includes an arrangement for continuously and automatically varying the rate of advance of the thermal transfer ribbon during printing, the rate of advance being correlated with the nature of the image being printed, and the variable advance rate being provided by a driven friction feed roller and a pair of ribbon guides which cooperate with the friction feed roller and are so positioned that the transfer ribbon is held tightly against the friction feed roller, contacting the circumference of the friction feed roller over more than 90° its circumference and preferably at least 180° of its circumference.

15 Claims, 6 Drawing Sheets

10'
28
12
27'
26
18a
41
16
42
18
15
17
12
11
13
19
20
22a
22
14
21

THERMAL TRANSFER PRINTER WITH CONTROLLED RIBBON FEED

FIELD OF THE INVENTION

The present invention relates to thermal transfer printers and more specifically to a thermal transfer printer in which the ratio of the thermal transfer ribbon feed rate is controlled in order to reduce the consumption of the transfer ribbon.

BACKGROUND OF THE INVENTION

Thermal transfer printers are well known in the prior art. In such printers, a transfer ribbon typically having a polyester backing coated on one side with a heat-transferable ink layer is interposed between the surface of a nonsensitized paper and a thermal printhead having a line of very small heater elements. When an electrical pulse is applied to a selected subset of the heater elements, localized melting and transfer of the ink to the paper occurs under the energized elements, resulting in a corresponding line of dots being transferred to the paper.

After each line of dots is printed, the paper or the printhead is repositioned to locate the printhead over an adjacent location and the transfer ribbon is repositioned to provide a replenished ink coating. Then the selecting and heating process is repeated to print an adjacent line of dots. Depending on the number and pattern of heater elements and the directions of motion of the thermal head and the paper, arrays of dots can produce individual characters or successive rows of dots which combine to form complete printed lines of text or graphics. It is common to transfer essentially all of the ink from the transfer ribbon to the paper and reposition the transfer ribbon by at least the dimension of the dots printed.

An alternate mode of operation is to increase the ink coating thickness and limit the heat energy so as to transfer only a portion of the ink layer to the paper at each dot line. Various attempts have thus been made to minimize consumption of transfer ribbon. One attempt includes the use of a "multipass" transfer ribbon with a thermal printer that has a removable, reversible ribbon carriage. Such ribbon carriage permits the user to remove the transfer ribbon at the end of each pass and reverse it, thereby permitting reuse of the transfer ribbon. Successful reuse has been reported up to five passes when used for printing bar codes and ten passes when used for printing fonts only. In an alternative arrangement, the thermal printer is adapted to rewind the partially used transfer ribbon automatically at the end of each pass. These approaches result in a complicated structure for the thermal printer because of the need to provide a removable ribbon spindle carriage to permit ribbon reversal or a special head lift mechanism to accommodate ribbon rewind. Moreover, the former arrangement requires user intervention to manually remove and reverse the ribbon carriage five to ten times over its lifetime.

Another approach has been to control the ribbon advance feed rate relative to the paper advance feed rate to extend the life of the transfer ribbon. By using this mode, the transfer ribbon can be repositioned by less than the thickness of the dot line, resulting in a reduced consumption of transfer ribbon.

In U.S. Pat. No. 4,558,963 to S. L. Applegate et al., conservation of ribbon in an impact printer is achieved by underfeeding the ribbon relative to movement of the printhead to provide a low ratio of ribbon speed to paper speed for drafts and a high ratio for final versions. However, this patent does not disclose continuously variable ratios or automatic control of such ratios. In U.S. Pat. No. 3,984,809 to Dertouzos et al., there is disclosed a thermal-transfer printer in which the ribbon moves slower than the paper. A roller is driven and moves the ribbon in contact therewith. However, the ribbon contacts the driven roller only for about 90° of its circumference. In Japanese patent No. 199972 there is disclosed an image former in which transfer ribbon is pressed against a platen roller by a pair of idler rollers. However, the extent of contact of the transfer ribbon with the platen roller is much less than 180° and the platen roller is not driven.

Effective use of the transfer ribbon is directly related to the rate of advancement of the transfer ribbon during a printing operation. If the transfer ribbon is advanced too slowly the increased time during which a given area of transfer ribbon is heated combined with the back tension from the ribbon take-up spool will result in stretching of the transfer ribbon at the point of heating. If the image being printed requires heating across much of the transfer ribbon width, the ribbon will break. This problem is negligible for small text because only a small number of heater elements are energized on each dot line. Printing of bar codes, large block letters, or graphics (hereinafter sometimes collectively referred to has "graphic-type images"), however, requires energizing adjacent blocks of heater elements or a significant number of the total heater elements or a significant number of the total heater elements for a number of several consecutive dot rows. Generally this will result in the breaking of the transfer ribbon unless the ribbon feed rate is increased when such images are printed. If the ribbon is advanced too fast, some inked portions will not be used, thereby wasting portions of the ribbon.

SUMMARY OF THE INVENTION

An object of the present invention is to provide an improved thermal transfer printer.

Another object of the present invention is to provide a thermal transfer printer which minimizes the consumption of transfer ribbon.

A further object of the present invention is to provide a thermal transfer printer having an improved transfer ribbon drive mechanism.

Yet another object of the present invention is to provide a thermal transfer printer in which the speed of advancement of the transfer ribbon relative to the speed of the medium is varied automatically as a function of the image being printed.

A further object is to provide an improved package for a supply of transfer ribbon for a thermal transfer printer.

The present invention provides a thermal transfer printer providing controlled feed for a thermal transfer ribbon comprising a thermal printhead, advance means for advancing a print receiving medium past said thermal printhead, the thermal transfer ribbon being disposed between the print receiving medium and said thermal printhead, bias means maintaining the thermal transfer ribbon, the print receiving medium, and said thermal printhead in physical contact, means for determining the rate of advance of the thermal transfer ribbon independently of the rate of advance of the print receiving medium, and control means for continuously varying the rate of advance of the thermal transfer ribbon during printing. In accordance with the invention the rate of advance determining means includes a friction roller which is driven by the control means and ribbon guide means cooperating with the friction roller to create and maximize the frictional drag of the friction roller on the thermal transfer ribbon. The ribbon guide means is constructed and arranged to maintain the thermal transfer ribbon in contact with said friction roller along more than 90° and preferably at least 180° of the circumference of said friction roller.

Further, in accordance with the present invention, there is provided a thermal transfer printer providing controlled feed for a thermal transfer ribbon comprising a thermal printhead, advance means for advancing a print receiving medium past said thermal printhead, said thermal printhead having a plurality of heater elements disposed transverse to the direction of advancement of the web, the thermal transfer ribbon being disposed between the print receiving medium and said thermal printhead, bias means maintaining the thermal transfer ribbon, the print receiving medium, and said thermal printhead in physical contact, select means for producing select signals for selecting heater elements to be energized, ribbon advance means for advancing the thermal transfer ribbon past said thermal printhead, and including means for determining the rate of advance of the thermal transfer ribbon independently of the rate of advance of the print receiving medium, and control means responsive to said select signals for controlling said ribbon advance means to vary the rate of advancement of the thermal transfer ribbon as a function of the number of heater elements selected.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF A PREFERRED EMBODIMENT

Figure 1:
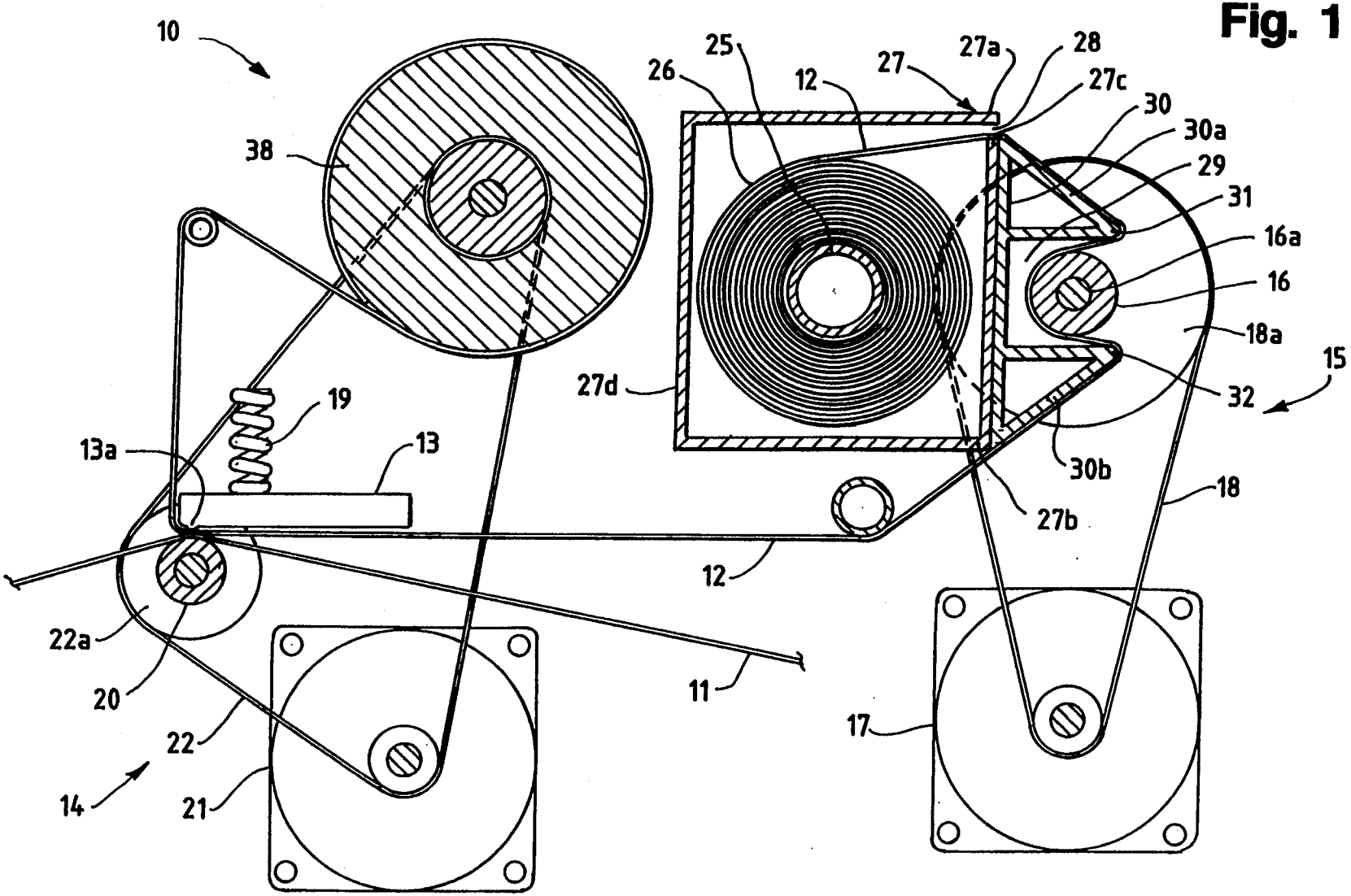
FIG. 1 is a simplified representation of a thermal transfer printer provided by the present invention and which includes a transfer ribbon package adapted to cooperate with the printer in advancing the transfer ribbon.

Referring to the drawings, FIG. 1 is a simplified representation of a thermal transfer printer 10 incorporating the present invention. The thermal transfer printer 10 includes a thermal printhead 13 for printing images or indicia on a web of material 11, such as a roll of pressure sensitive labels, by transferring ink from a transfer ribbon 12 to the material 11. The thermal transfer printer 10 includes a web advance mechanism 14 for advancing the web of material 11 relative to the thermal printhead 13, and a transfer ribbon advance mechanism 15 including a friction roller 16 mounted on a roller shaft **16*a* for advancing the transfer ribbon 12 relative to the thermal printhead 13. The thermal printer 10 includes a control circuit 50 (FIG. 4) for controlling the operation of the printhead 13, the stepper motor 17 of the ribbon advance mechanism 15 and the stepper motor 21 of the web advance mechanism 14**.

The transfer ribbon 12 is interposed between the web of material 11 and a line of heater elements **13*a* of the thermal printhead 13** which are positioned transverse to the direction of movement of the web.

The web advance mechanism 14 includes platen roller 20 which is driven by a stepper motor 21 through a belt 22 and drive pulley **22*a* to advance a web of labels past the thermal printhead 13** during printing.

The transfer ribbon advance mechanism 15 includes the friction roller 16, a stepper motor 17, and a belt 18 and drive pulley **18*a*. The transfer ribbon 12 is wound on a core 25 forming a supply roll 26 which is contained in a ribbon box or cartridge 27. The thermal printer is adapted to receive and support the ribbon containing cartridge 27 in cooperative relationship with the friction roller 16, enabling the transfer ribbon 12 to be drawn out of the package by the friction roller 16 which is driven by a stepper motor 17 through belt 18 and drive pulley 18*a***.

Figure 2:
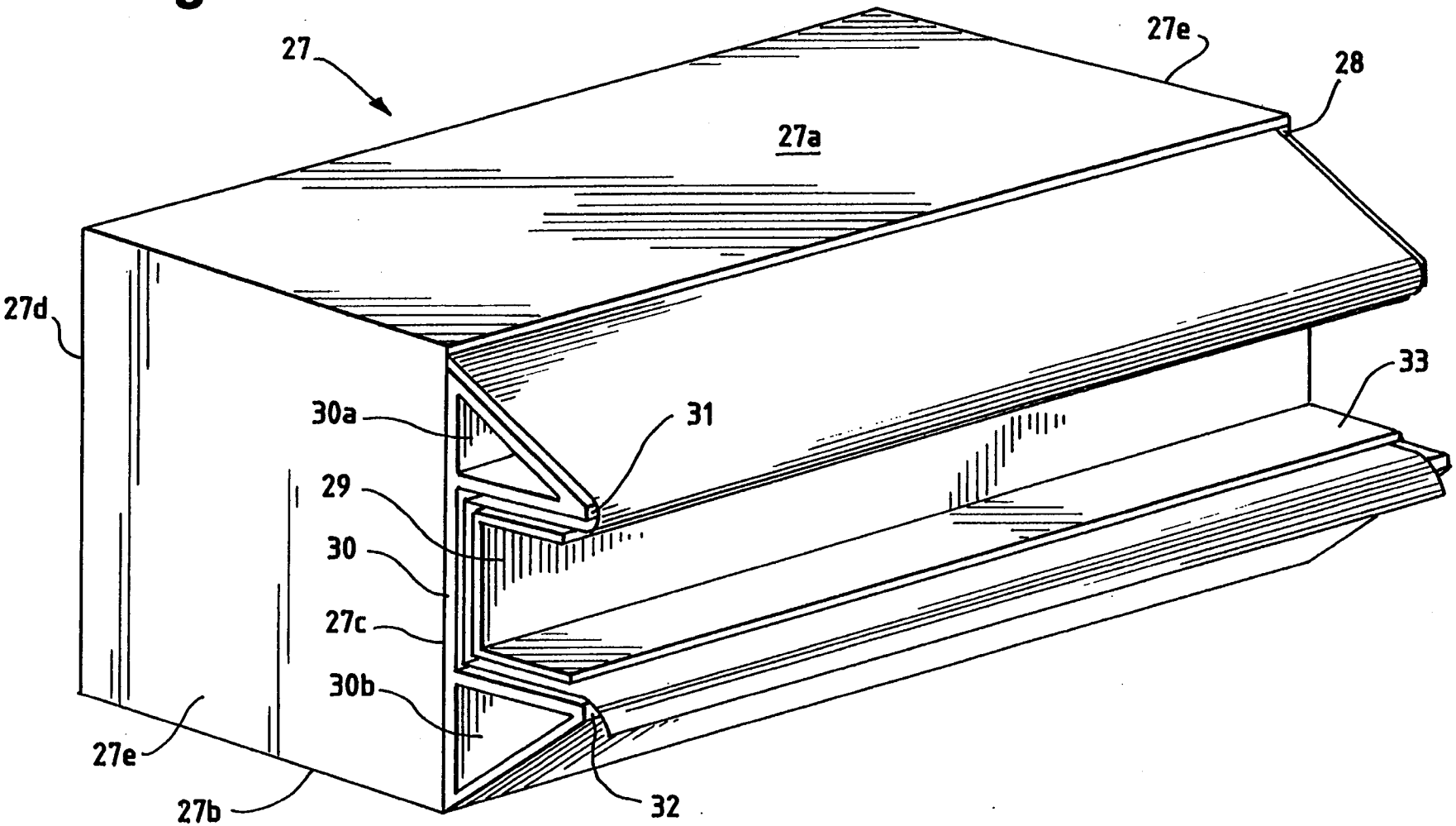
FIG. 2 is an isometric view of the transfer ribbon package used with the thermal transfer printer shown in FIG. 1.

Referring additionally to FIG. 2, the ribbon box or cartridge 27 is generally rectangular in shape and has a top wall **27*a*, a bottom 27*b*, a front wall 27*c*, a back wall 27*d* and side walls 27*e*. The transfer ribbon 12 is drawn out of the ribbon box 27 through a transverse slot 28 between the top wall 27*a* and front wall 27*c*. Preferably, the ribbon box 27** is made of paperboard, but the package may be formed of plastic or other materials.

The ribbon box or cartridge 27 has a ribbon guide extension 30 including ribbon guides 31 and 32, which cooperates with the friction roller 16 in controlling the transfer ribbon advance rate. The ribbon guide extension 30 is mounted on front wall **27*c* and defines a channel 29 which partially encloses the friction roller 16. The ribbon guide extension 30 includes an upper portion 30*a* and a lower portion 30*b*, each having a triangular-shaped cross section, defining the upper ribbon guide 31 and the lower ribbon guide 32. When the ribbon box or cartridge 27 is installed in the printer 10, the ribbon guides 31 and 32 are located forwardly of the friction roller 16 and cooperate with the friction roller to define the wrap angle of the transfer ribbon 12 around the friction roller 16. The transfer ribbon 12 contacts the friction roller 16 over a substantial portion of its circumference, which in the particular embodiment depicted, is about 180°. The transfer ribbon 12 can be caused to contact the friction roller 16 over a portion of its circumference which is more than 90° by changing the position of the guides 31 and 32 relative to the friction roller 16, and/or the shape of the ribbon guide extension 30 and, in particular, portions 30***a* and 30*b* thereof.

The ribbon box or cartridge 27 further includes a C-shaped cover 33 removably positionable over the transfer ribbon in channel 29 to maintain the transfer ribbon 12 out of engagement with the friction roller 16 during installation of the box or cartridge 27 in the thermal printer 10 and while the transfer ribbon 12 is being threaded through the thermal transfer printer 10. This eliminates manual threading of the transfer ribbon 12 around the supporting structure (not shown) of the friction roller 16. The cover 33 is removed after the transfer ribbon 12 has been threaded through the thermal printer 10. The transfer ribbon 12 is automatically brought into contact with friction roller 16 and tensioned when ribbon is first pulled from box or cartridge 27 by operation of thermal printer 10.

The ribbon 12 is re-spooled after printing onto a clutch driven take-up spindle 38 in the manner known in the art. The torque applied to the takeup spindle is minimized to that required to re-spool the ribbon. In the absence of a greater retarding force on the supply roll 26 or on the friction roller 16, frictional force between the transfer ribbon 12 and the web of material 11 causes equal lengths of each to be drawn into the printhead 13.

The transfer ribbon 12 is wrapped around a portion of friction roller 16 to the maximum practical wrap angle to maximize the available frictional drag of the friction roller 16 on the transfer ribbon 12. This allows the rotation of the friction roller 16 to completely determine the amount of transfer ribbon 12 which is fed independently of the amount fed of the web of material 11. Friction roller 16 is driven by stepper motor 17 which, although electrically driven, acts as a brake. The present invention can equivalently be practiced using a controllable braking device.

Referring to FIG. 1, during printing operations, the control circuit 50 (FIG. 4) provides drive signals for the stepper motor 21 to rotate the platen roller 20 at a given speed which causes the material 11 to be moved at a corresponding linear speed. The control circuit provides drive signals for the stepper motor 17 to rotate the friction roller 16 at a much slower speed, whereby the speed of the transfer ribbon 12 is also much slower. The step angle of the stepper motor 17, the ratio of the belt drive, and the circumference of the friction roller 16 are chosen to allow incremental advance of the transfer ribbon 12 in a small ratio to the incremental advance of the web material 11. By this arrangement, a variable number of steps of the stepper motor 17 can be used to vary the ribbon feed ratio for the maximum practical conservation of transfer ribbon consistent with avoidance of transfer ribbon breakage and the required print quality.

The printhead heater elements 13*a*, the web of material 11, and the transfer ribbon 12 are pressed into contact and into engagement with the platen roller 20 by the action of a bias mechanism, represented by spring 19. The platen roller 20 tends to pull not only the material 11, but the transfer ribbon 12 at its higher speed. It is important to maximize the retrograde force exerted by the friction roller 16 so that the transfer ribbon speed is controlled by the speed of the friction roller and not by the speed of the platen roller 20. Thus, good frictional engagement between the transfer ribbon 12 and the friction roller 16 is required. In order to frictionally hold the transfer ribbon tightly against the friction-feed roller 16, the guides 31 and 32 are so positioned to cause the transfer ribbon to contact the friction roller 16 over a substantial portion of its circumferential extent, more than 90°, and, preferably, 180° or more.

Figure 3:
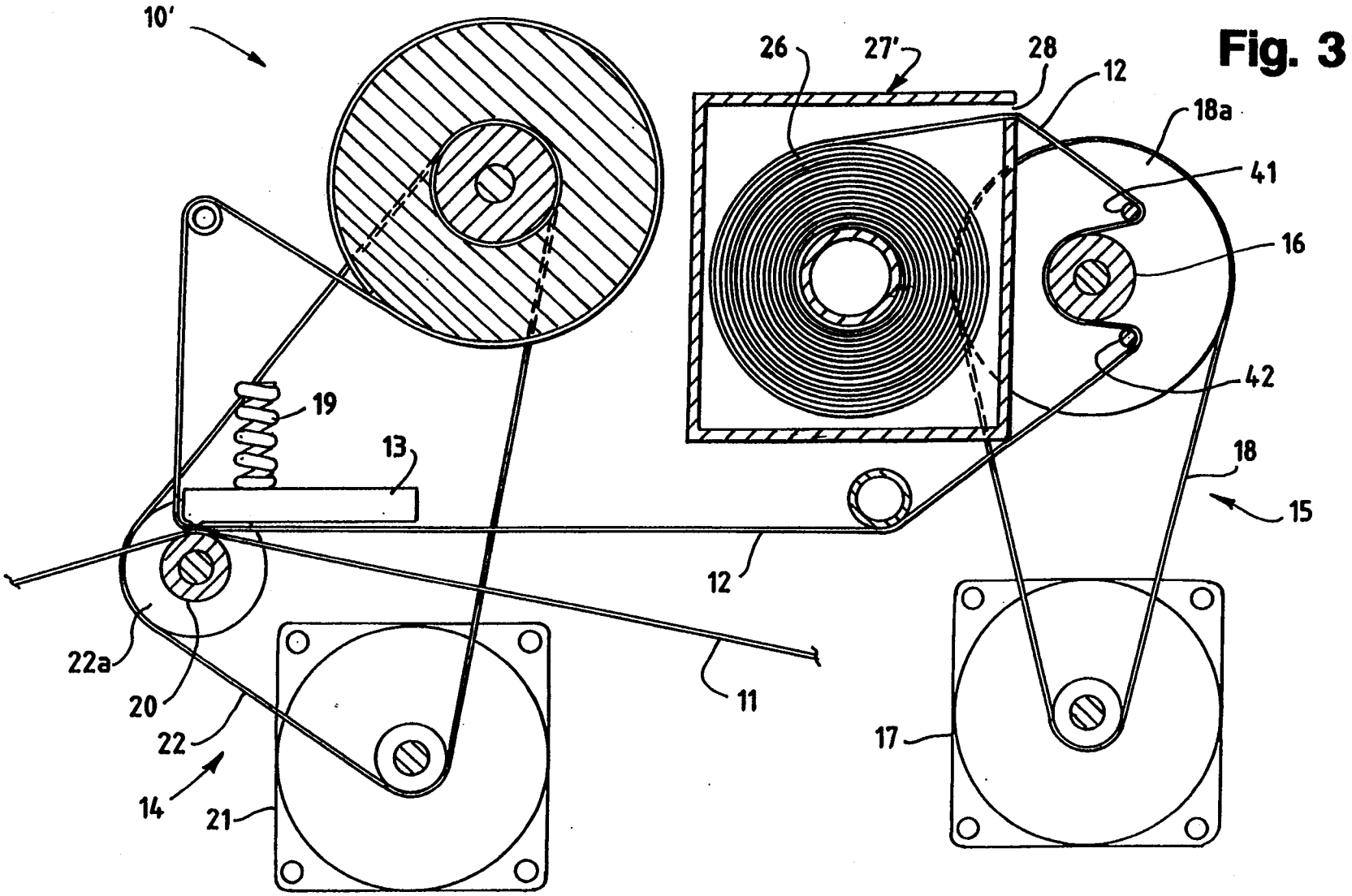
FIG. 3 is a simplified representation of a further embodiment of a thermal transfer printer provided by the present invention.

FIG. 3 shows an alternate embodiment of a thermal printer 10' in which the wrap angle for the transfer ribbon 12 is obtained by guide rollers 41 and 42 which are part of the thermal transfer printer 10'. In this arrangement, the ribbon box 27' does not include a guide extension 30 as does the ribbon box 27 shown in FIG. 1, and there is no cooperation between the ribbon package 27' and the friction roller 16. The guide rollers 41 and 42 are mounted on the printer forwardly of the friction roller 16, with guide rollers 41 and 42 located, respectively, above and below the friction roller 16 in positions corresponding to the positions of ribbon guides 31 and 32 of ribbon box 27 (FIG. 1).

The transfer ribbon 12 includes a substrate or backing film having a layer of heat transferable ink disposed on a surface thereof. In addition to the transferring ink, the heating of transfer ribbon 12 softens the backing film. If the ribbon feed ratio is excessively reduced, the increased time during which a given area of transfer ribbon 12 is heated combined with the back tension from the friction roller 16 stretches the transfer ribbon 12 at the point of heating. If the image being printed requires heating across much of the transfer ribbon width, the ribbon breaks. This problem is negligible for small text because only a small number of heater elements are energized on each dot line. Printing of bar codes, large block letters, or graphics, however, requires energizing adjacent blocks of heater elements or a significant number of the total heater elements for a number of several consecutive dot rows, breaking the transfer ribbon 12 unless the ribbon feed rate is increased when such images are printed.

Figure 4:
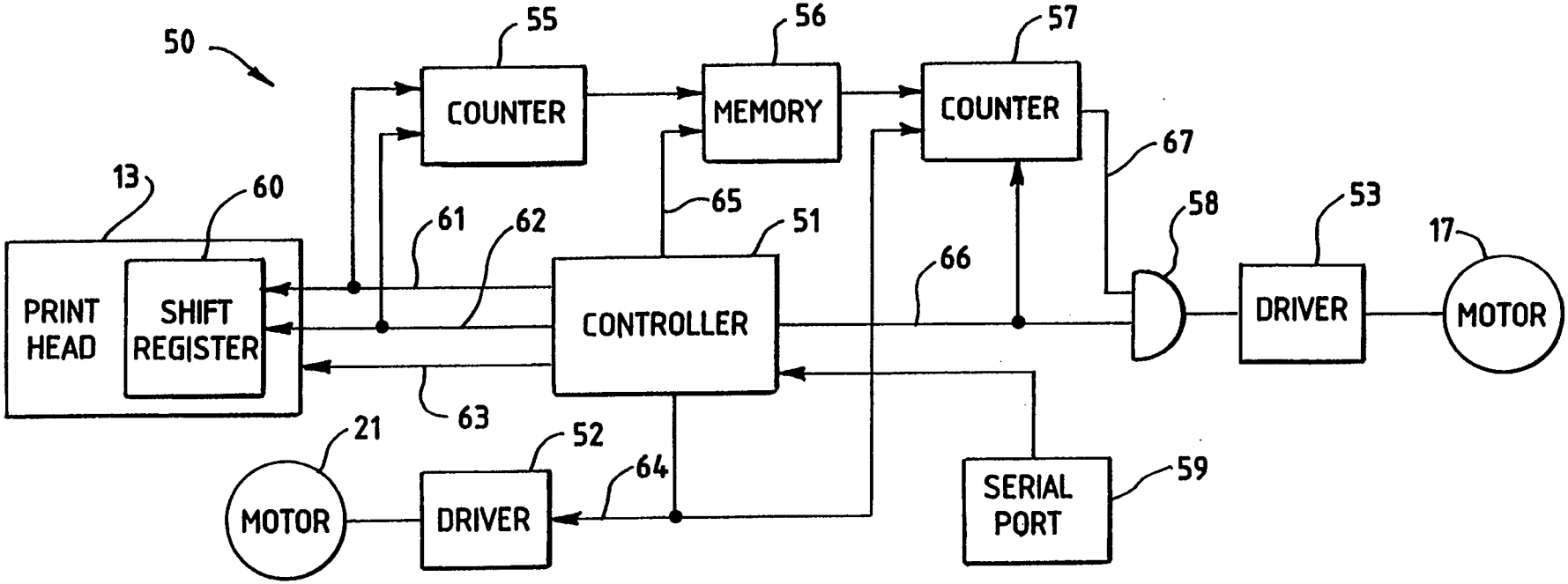
FIG. 4 is a block diagram of a control circuit of the thermal transfer printers shown in FIGS. 1 and 3.

FIG. 4 is a block diagram of the control circuit 50 which controls the operation of the printhead 13, the stepper motor 17 of the ribbon advance mechanism 15 and the stepper motor 21 of the web advance mechanism 14. The control circuit 50 includes a controller 51, a driver circuit 52 associated with the paper advance stepper motor 21, a driver circuit 53 associated with the transfer ribbon advance stepper motor 17, a pulse counter 55, a read only memory 56, a pulse counter 57 and an AND gate 58.

The controller 51 include a microprocessor programmed to produce signals for selectively energizing the heater elements 13*a* of the thermal printhead 13, and signals for enabling driver circuit 52 and driver circuit 53 to advance the web material 11 and the transfer ribbon 12, respectively. The controller 51 responds to information supplied over a data input means 59, typically a serial interface to the user's computer, to image the information to be imprinted on the web material. The data input means 59 also permits the user to enter command information into the printer for selecting ribbon feed advance ranges. The controller 51 generates data representing the information on a line by line basis. The data produced by the controller 51 selects the heater elements 13*a* of printhead 13 to be energized. Typically, logic ONE bits select heater elements to be energized while logic ZERO bits select heater elements not to be energized. The logic ONE and logic ZERO bits are provided serially on conductor 61 which is connected to the data input of a register 60 of the printhead 13. The data bits are loaded into the register 60 under the control of clock pulses provided on conductor 62 by the controller 51. After all of the data bits have been stored in the register 60, the controller 51 applies a strobe signal on conductor 63 for a fixed length of time to energize the selected heater elements. After each line of information has been printed, the controller 51 provides an advance signal on conductor 64. The advance signal is applied to driver circuit 52 causing the stepper motor 21 to be advanced one step, thereby advancing the web material an increment corresponding to the dot line thickness.

Control circuit 50 controls the speeds of the friction roller 16 and/or the platen roller 20 and the relative speed is controlled in accordance with the image being printed. The user may select a relative speed to achieve a desired level of ribbon conservation or a desired print density. The chosen speed may, however, be such as to cause ribbon breakage when certain portions of bar codes or images are printed. Further, the microprocessor does not need to advance the transfer ribbon 12 when no printing is taking place, that is, transfer ribbon advance can be interrupted while white space on the paper is being traversed.

In accordance with one aspect of the invention, the transfer ribbon feed rate is varied automatically as a function of the image being printed. For the purpose of providing a variable feed rate for the ribbon stepper motor 17, counter 55 counts the number of logic ONE bits provided on conductor 61. The clock signals provided on conductor 62 cause the counter 55 to advance one count for each logic ONE bit provided on conductor 61. The count registered by the counter 55 provides an address for the read only memory 56. The read only memory 56 contains a plurality of "look-up" tables storing data correlating the number of steps for the transfer ribbon stepper motor 17 with the number of heater elements to be energized for printing different characters. The data for the "look-up" tables contained in the memory 56 is obtained empirically by applying various transfer ribbon advance rates under different heater element count conditions and determining optimum feed rates for each heater element count. The "look-up" tables are addressable by addresses produced by the counter 55. The controller 51 provides a select command on conductor 65 to select which "look-up" table is used, allowing for different ranges of ribbon feed ratios. Some of the "look-up" tables contained in the read only memory 56 include constant ribbon feed step counts. The constant feed data "look-up" tables are selectable by the command provided on conductor 65 by the controller 51 in response to information entered into the printer controller 51 by the user via input means 59. When one of the constant feed data tables is selected, the automatic addressing mode which uses the addresses produced by counter 55 is overridden and the transfer ribbon feed rate becomes independent of the heater element count. This user selectable feature permits the transfer ribbon feed rate to be changed depending upon the type of image being printed. The constant feed tables provide a different range of ribbon feed ratio depending on the required print quality, the absolute web speed, and the nature of the printed image.

The ribbon step count contained in the selected table of memory 56 is preloaded into the counter 57 in response to the advance signal applied to conductor 64. The counter 57 is counted down by clock pulses provided on conductor 66 by controller 51, producing an enabling signal on conductor 67 which enables AND gate 58 to pass clock pulses to driver circuit 53, thereby advancing the ribbon feed motor the number of steps indicated by the count loaded into counter 57.

During a label printing operation, the controller 51 sequentially loads serial data a line, or "dot row", at a time into register 60 for selecting subsets of heater elements 13*a* of printhead 13 to be energized for all of the lines of data to be printed on the label. The data bits are loaded into the register 60 by a clock signal provided on conductor 62. After all bits for a line of printing have been loaded into the register 60, the controller 51 applies the strobe signal to the print head 13 for a fixed length of time to cause the selected subset of heater elements to be energized.

As the data bits are loaded serially into the printhead register 60, the counter 55 is incremented to a count indicative of the number of logic ONE level bits provided on conductor 61, which in turn corresponds to the number of heater elements to be energized in printing the current line of data. When all of the bits have been loaded into the register 60, the count representing the number of heater elements to be energized is applied to the memory 56 to address the memory location which stores the data representing the number of steps for the thermal ribbon advance stepper motor 17.

Controller 51 then applies the advance signal to conductor 64, enabling driver 52 to advance the web stepping motor 21 by one step, thereby incrementally advancing the web material 11 by the dot line thickness.

Also, the ribbon step count contained in the selected table of memory 56 is pre-loaded into the counter 57 in response to the advance signal provided on conductor 64 for advancing the paper web. The counter 57 is counted down by clock pulses provided on conductor 66, enabling AND gate 58 to pass clock pulses to drive circuit 53, thereby advancing the ribbon feed stepper motor the number of steps indicated by the count loaded into counter 57. This process is repeated to progressively form a complete image on a line-to-line basis on the label.

Figure 5:
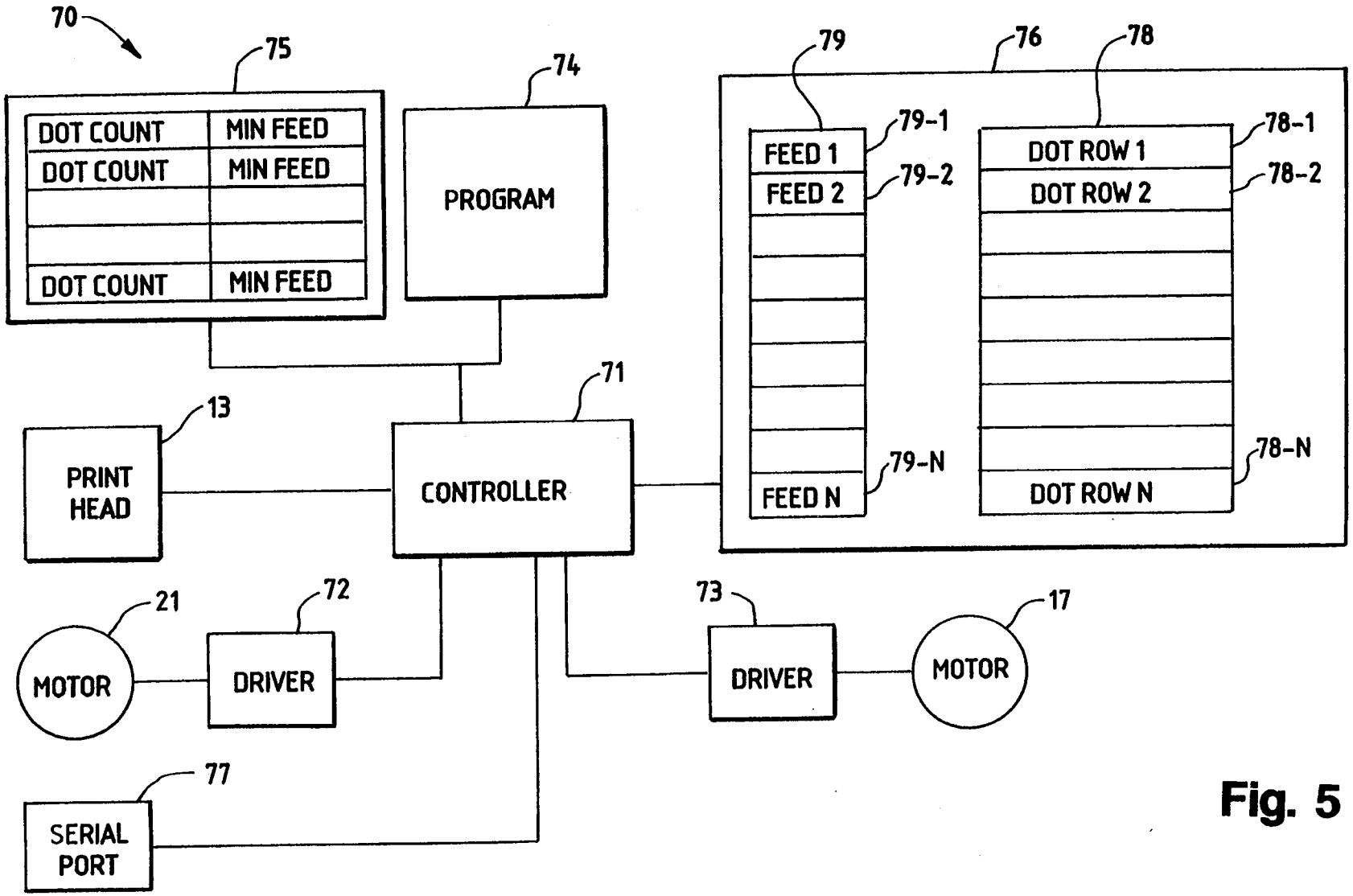
FIG. 5 is a block diagram of a further embodiment of a control circuit for the thermal transfer printer.

Referring to FIG. 5, there is illustrated a block diagram of a second embodiment for a control circuit 70 for controlling the printhead 13, the transfer ribbon advance stepper motor 17 and the web material stepper motor 21, as applied to printing small text and bar code images. The control circuit 70 includes a controller 71 including a microprocessor, a driver circuit 72 associated with the stepper motor 21, a driver circuit 73 associated with the transfer ribbon stepper motor 17, a program memory 74, a read only memory 75 and a data memory 76. A data input means 77 permits imaging data to be supplied to the printer and permits the user to enter command information for selecting minimum ribbon feed advance rates, etc. The program memory 74 stores the operating program for the microprocessor. The read only memory 75 stores a "look-up" table which correlates the number of heater elements to be energized for a given printing operation with the minimum number of feed steps for the transfer ribbon feed stepper motor 17 required to print a dot row having a given number of dots without causing breakage of the transfer ribbon.

The data memory 76 is a bit mapped memory which stores data representing the complete image for the label to be printed during a given printing operation. The stored information includes location, size, content, and other information for each text and bar code field to be printed. The data memory 76 has groups of memory locations 78 for storing imaging data representing the configuration of each dot row to be printed and associated groups of memory locations 79 for storing ribbon feed data indicative of the number of steps for the ribbon feed advance motor after the associated dot row has been printed.

The imaging data is stored in memory locations 78 under the control of the controller 71 during the imaging of the label to be printed. The ribbon feed advance data is obtained from the "look-up" table of read only memory 75 under the control of the controller 71, using the imaging data which has been stored in memory locations 78. The function of determining the amount of ribbon feed advance steps is performed by subprograms of the controller 71 which are contained in the program memory 74.

The microprocessor of the controller 71 operates under the control of the operating program stored in memory 74 to receive and image a label to be printed and to store appropriate imaging data and ribbon feed data in the data memory 76. The processor initializes the system, clearing the data memory 76 and then storing the imaging data for the label to be printed on a line per line basis. Assuming, for example, the image to be printed includes N rows, the appropriate dot row data is stored in successive memory storage locations 78-1, 78-2,. . . 78-N. The data stored in memory location 78-1 through 78-N represent a bit mapped or complete image of the label to be printed. A software counter indexing counter stores information indicating the number of dot rows to be printed for the label that has been imaged, and which dot row is being printed during the printing operation.

Then, the processor under program control determines the minimum ribbon feed rate for each element of dot row data stored in the memory locations 78. For small text (hereinafter "text"), only a small number of heater elements are energized in printing each dot line. However, printing of bar codes, requires energizing adjacent blocks of heater elements or a significant number of the total heater elements for a number of several consecutive dot rows. Accordingly, different minimum transfer ribbon feed rates are established for small text image printing and bar code image printing. A preselected default ribbon value is preselected for text image print operations and this default ribbon feed value is stored in a memory location associated with the memory locations storing text image dot row data. Similarly, a default ribbon feed value is preselected for all bar code image rows to be printed and this ribbon feed value is stored in memory locations 79-1 to 79-N of the group of memory locations 79 corresponding to the dot row data for bar code image portions of the label image. The operating program determines whether a field contains text image or bar code image and selects the proper ribbon feed value to be stored in association with that dot row data. The default ribbon feed for text images may be changed by the user, if desired, by entering suitable information into the controller 71 via input means 77.

When the imaging data and ribbon feed data have been stored in the data memory 76, the operating program begins the printing sequence. The dot row data for each image line is transferred sequentially to the printhead 13 one dot row at a time to select a subset of heater elements to be energized. As each row of dot row data is transferred, the number of dots to be printed in that dot row, i.e., the number of logic ONE level bits, are counted and this result is used as a look-up address for memory 75 to obtain the value of the minimum feed for the dot count data being supplied to the printhead. Then, the microprocessor under program control energizes the subset of printhead heaters 13*a* to print the image represented by the current dot row data which has been supplied to the printhead 13.

Then, the microprocessor causes the web of material 11 to be advanced by an amount corresponding to one dot row by providing a drive pulse for driver circuit 72 for stepping the web advance motor 21 one increment. Also, the microprocessor determines which is the greater, the minimum ribbon feed value obtained from memory 75 by the heater element count or the ribbon feed value stored in locations 79 of memory 76 in association with the dot row data stored in locations 78 of memory 76. The transfer ribbon 12 is advanced by the greater of the heater element count minimum ribbon feed or the feed count value stored in the data memory 76. The foregoing sequence of operations is repeated until the entire label has been printed.

Figure 6:
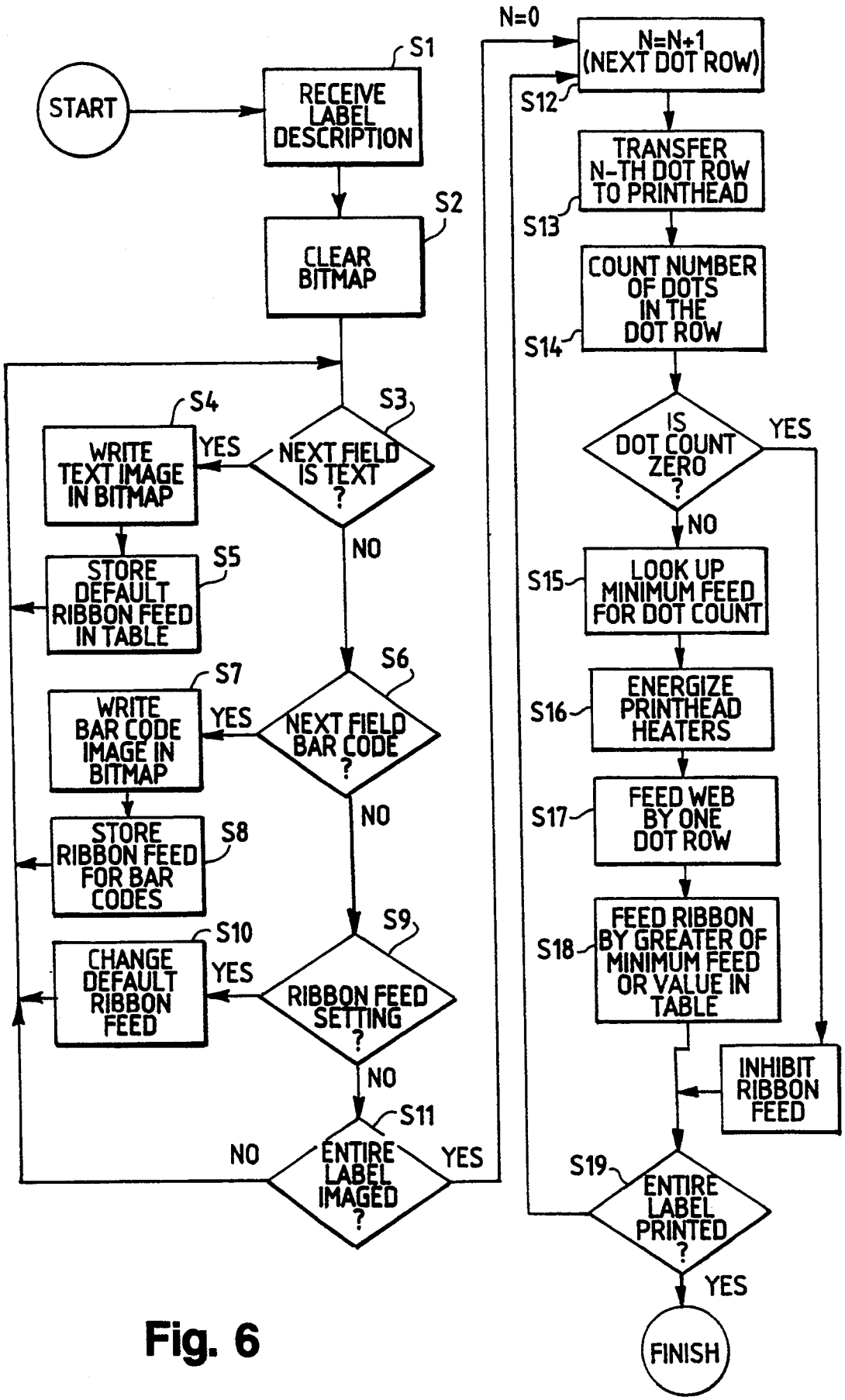
FIG. 6 is a flow chart of the program for the controller of the control circuit shown in FIG. 5.

Referring to FIG. 6, there is a process flow chart for the operating program for controlling the microprocessor of controller 71 in printing a label assumed to include small text ("text") and bar code images. At step S1, the controller 71 receives a description of a label to be printed, including the location, size, content, and other information for each text and bar code field to be printed and a selection of the default ribbon feed rate. At step S2, the bit mapped memory 76 is cleared in preparation for imaging the label to be printed.

At steps S3 and S6, text and bar code fields are separated to enable the appropriate preselected ribbon feed data to be applied. At step S4, dot images of text items are written into the bit mapped locations 78 of the data memory 76. At step S5, the default ribbon feed amount is written in the memory locations 79 corresponding to the dot rows written.

At step S7, dot images of bar code symbols are written into the bit mapped locations 78 of data memory 76. At step S8, the predetermined ribbon feed amount for printing bar codes is stored in the memory locations 79 corresponding to the dot rows written.

Steps S9 and S10 enable user selection of the default ribbon feed rate for text image printing. The user enters the command information for selecting a ribbon feed rate via serial port 77 (FIG. 5). This allows the user to choose a minimum feed rate consistent with the minimum acceptable print quality. The feed rate chosen applies to all subsequent text and graphic-type images unless its size or density exceeds the dot count at which ribbon breakage can occur, in which case, the feed rate is increased, at step S15, to the minimum ribbon feed rate required to prevent ribbon breakage. Bar codes, however, are expected to meet certain quality standards, and thus, the lower limit on the feed rate for bar codes is preselectable independently of the minimum feed rate for text and text and other graphic-type images. Consequently bar codes have their own default feed rate. To prevent ribbon breakage, the bar code feed rate is also subject to being increased, at step S15, to the minimum ribbon feed rate required to prevent ribbon breakage.

At step S11, a determination is made as to whether or not the entire label has been imaged. If not, the sequence between steps S3 and S11 is repeated until the entire label has been imaged.

When the entire label has been imaged, then at step S12, printing of the first dot row is initiated. The software indexing counter is advanced from N=0 to N=1 to indicate that the first dot row is being printed. At step S13, data representing the first dot row is transferred to the printhead 13.

At step S14, the number of heater elements to be heated to print the first dot row is counted, and at step S15, a table lookup is performed using the heater element count to address memory 75 to determine the minimum ribbon feed rate required to avoid ribbon breakage for the number of heater elements to be energized as indicated by the dot row data that has been transferred to the printhead. If the feed rate chosen for a segment of text, or a bar code of a given size or density is less than the minimum feed rate corresponding to, the dot count at which ribbon breakage can occur, the ribbon feed rate is increased to the minimum ribbon feed rate required to prevent ribbon breakage.

At step S16, the printhead heater elements identified by logic ONE level bits of the row count data are energized for a predetermined period to print the row data on the label.

At step S17, the controller 17 produces an advance pulse for driver circuit 72 to cause stepper motor 21 to advance the web by one dot row.

At step S18, the ribbon feed rate to be used is determined. The minimum ribbon feed rate for the number of heater elements currently being energized, which rate is obtained from memory 75, is compared with the ribbon feed rate stored in locations 79 of memory 76 for the dot row being printed. The microprocessor determines the greater of the minimum feed and the value stored in the data memory along with the dot row data. The transfer ribbon 11 is advanced the number of steps indicated by the selected advance rate.

After the first dot row has been printed, the software indexing counter is incremented to a count of two, and the sequence between steps S12 and S19 is repeated to print the second dot row on the label. The sequence between steps S12 and S19 is repeated until the entire label has been printed, that is when "N" dot rows have been printed.

We claim:

1. A thermal transfer printer providing controlled feed for a thermal transfer ribbon comprising a thermal printhead, advance means for advancing a print receiving medium past said thermal printhead, said thermal printhead having a plurality of heater elements disposed transverse to the direction of advancement of the medium, the thermal transfer ribbon being disposed between the print receiving medium and said thermal printhead;

bias means maintaining the thermal transfer ribbon, the print receiving medium, and said thermal printhead in physical contact, select means for producing select signals for selecting heater elements to be energized, ribbon advance means for advancing the thermal transfer ribbon past said thermal printhead, and including means for determining the rate of advance of the thermal transfer ribbon relative to the rate of advance of the print receiving medium, and control means responsive to said select signals for controlling said ribbon advance means to vary the rate of advancement of the thermal transfer ribbon as a function of the number of heater elements selected, said control means including means for determining the number of heater elements selected by said select means by counting said select signals, and memory means having a plurality of addressable data storage locations with different data storage locations storing data representing different rates of advancement for the transfer ribbon as a function of the number of heater elements being energized, the count of the number of select signals produced being used to address said memory means to obtain the transfer ribbon advancement rate corresponding to the number of heater elements being energized.

2. The thermal transfer printer of claim 1, wherein the rate of advance of the transfer ribbon during printing is increased in correspondence with the number of select signals produced.

3. The thermal transfer printer of claim 1, wherein said control means is responsive to a command supplied to the thermal printer to select the rate of advance of the thermal transfer ribbon during printing.

4. The thermal transfer printer of claim 1, wherein said select signals are indicative of the image being printed for varying the rate of advance of the thermal transfer ribbon during printing.

5. The thermal transfer printer of claim 4, wherein said control means inhibits advancement of the thermal transfer ribbon when unprinted portions of the medium are being advanced past said thermal printhead.

6. The thermal transfer printer of claim 4, wherein a first portion of the image being printed includes a first type of data and a second portion of the image being printed includes a second type of data, and wherein said control means provides different varying rates of advance of the transfer ribbon during printing of said first and second portions of the image.

7. The thermal transfer printer of claim 6, wherein said control means inhibits advancement of the thermal transfer ribbon when unprinted portions of the medium are being advanced past said thermal printhead.

8. The thermal transfer printer of claim 1, wherein said rate of advance determining means includes a friction roller which is driven by said control means and ribbon guide means cooperating with said friction roller to maximize the frictional drag of said friction roller on the thermal transfer ribbon.

9. The thermal transfer printer of claim 8, wherein said ribbon guide means is constructed and arranged to maintain the thermal transfer ribbon in contact with said friction roller along more than 90° of the circumference of said friction roller.

10. The thermal transfer printer of claim 8, wherein said ribbon guide means comprise first and second guide rollers mounted on the printer in spaced apart relation.

11. The thermal transfer printer of claim 8, wherein said ribbon guide means is constructed and arranged to maintain the thermal transfer ribbon in contact with said friction roller along at least 180° of the circumference of said friction roller.

12. The thermal transfer printer of claim 1, including imaging memory means having a first plurality of data storage locations for storing imaging data representing the image to be printed on the print receiving medium, and a second plurality of data storage locations having data storage locations corresponding to said first plurality of data storage locations for storing ribbon advance data representing a preselected rate of thermal transfer ribbon advance as a function of imaging data stored in corresponding memory locations, said control means being operable in a first mode to store imaging data and corresponding ribbon advance rate data in said imaging memory means and being operable in a second mode to read out the imaging data and corresponding ribbon advance data for printing the image on the print receiving medium.

13. The thermal transfer printer of claim 12 including further memory means storing data representing minimum transfer ribbon feed rates, and means responding to imaging data read out of said imaging memory means to cause the transfer ribbon to be advanced by the greater of the minimum feed rate or the feed rate stored in said imaging memory means.

14. The thermal transfer printer of claim 1, wherein said rate of advance determining means includes means advancing the thermal transfer ribbon at a rate which is different from the rate of advance of the print receiving medium.

15. The thermal transfer printer of claim 14, wherein each of said advance means and said rate of advance determining means includes an electric motor.

* * * * *